US010907525B2

(12) United States Patent
Muramatsu

(10) Patent No.: US 10,907,525 B2
(45) Date of Patent: Feb. 2, 2021

(54) VEHICLE EXHAUST DEVICE

(71) Applicant: SUZUKI MOTOR CORPORATION, Hamamatsu (JP)

(72) Inventor: Takayoshi Muramatsu, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 175 days.

(21) Appl. No.: 16/178,128

(22) Filed: Nov. 1, 2018

(65) Prior Publication Data

US 2019/0136739 A1 May 9, 2019

(30) Foreign Application Priority Data

Nov. 9, 2017 (JP) ..... 2017-216206

(51) Int. Cl.

| | |
|---|---|
| ***F01N 1/00*** | (2006.01) |
| ***F01N 13/08*** | (2010.01) |
| ***F01N 1/08*** | (2006.01) |
| ***F01N 1/16*** | (2006.01) |
| ***F01N 1/02*** | (2006.01) |

(52) U.S. Cl.

CPC ..... *F01N 13/087* (2013.01); *F01N 1/006* (2013.01); *F01N 1/026* (2013.01); *F01N 1/083* (2013.01); *F01N 1/166* (2013.01); *F01N 1/168* (2013.01); *F01N 13/082* (2013.01); *F01N 2340/04* (2013.01); *F01N 2470/02* (2013.01); *F01N 2490/06* (2013.01); *F01N 2490/155* (2013.01); *F01N 2590/04* (2013.01)

(58) Field of Classification Search

CPC ..... F01N 1/166; F01N 1/083; F01N 13/087
USPC ..... 60/324
See application file for complete search history.

(56) References Cited

U.S. PATENT DOCUMENTS

| | | | | |
|---|---|---|---|---|
| 3,620,330 | A * | 11/1971 | Hall | F01N 1/003 181/266 |
| 4,913,260 | A * | 4/1990 | Fallon | F01N 1/02 137/487.5 |
| 5,173,577 | A * | 12/1992 | Clegg | F01N 1/02 181/269 |
| 6,176,347 | B1 * | 1/2001 | Chae | F01N 1/165 181/254 |
| 6,588,545 | B1 * | 7/2003 | Lee | F01N 1/088 181/264 |

(Continued)

FOREIGN PATENT DOCUMENTS

JP H 02-248609 A 10/1990

*Primary Examiner* — Jason D Shanske
(74) *Attorney, Agent, or Firm* — Stein IP, LLC

(57) ABSTRACT

A vehicle exhaust device includes a muffler body that has an interior space divided into a plurality of expansion chambers by a partition wall, and an exhaust control valve that switches an exhaust passage in the muffler body. The exhaust passage includes a first exhaust passage and a second exhaust passage. The first exhaust passage connects an upstream end and a downstream end of the muffler body straight. The second exhaust passage passes through the plurality of expansion chambers via a connecting pipe that connects the plurality of expansion chambers. A center of the first exhaust passage is located above a center of the muffler body in a vehicle upper-lower direction, and the second exhaust passage is located below the first exhaust passage.

10 Claims, 7 Drawing Sheets

(56) References Cited

U.S. PATENT DOCUMENTS

| | | | | |
|---|---|---|---|---|
| 2001/0018995 | A1* | 9/2001 | Uegane | F01N 1/16 181/275 |
| 2003/0115861 | A1* | 6/2003 | Chang | F01N 1/006 60/323 |
| 2006/0162995 | A1* | 7/2006 | Schorn | F01N 1/083 181/237 |
| 2007/0261395 | A1* | 11/2007 | Mahnken | F01N 1/165 60/297 |
| 2010/0071992 | A1* | 3/2010 | Feng | F01N 1/085 181/254 |
| 2012/0024507 | A1* | 2/2012 | Paze | F01N 13/1811 165/138 |
| 2014/0041959 | A1* | 2/2014 | Won | F01N 1/006 181/256 |
| 2014/0353077 | A1* | 12/2014 | Uchida | F01N 13/02 181/228 |
| 2015/0027566 | A1* | 1/2015 | Kobori | F01N 1/18 137/527 |
| 2016/0084127 | A1* | 3/2016 | Arai | F01N 1/084 60/312 |
| 2016/0222848 | A1* | 8/2016 | Hayama | F01N 1/166 |
| 2017/0051646 | A1* | 2/2017 | Kajikawa | F01N 1/08 |
| 2017/0058733 | A1* | 3/2017 | Peters | F01N 13/04 |
| 2017/0218806 | A1* | 8/2017 | LeRoy | G10K 11/161 |
| 2019/0055866 | A1* | 2/2019 | Kishikawa | F01N 1/089 |

* cited by examiner

EXHAUST CONTROL VALVE CLOSED

EXHAUST CONTROL VALVE OPEN

VEHICLE EXHAUST DEVICE

CROSS-REFERENCE TO RELATED APPLICATIONS

This application is based on and claims priority under 35 USC 119 from Japanese Patent Application No. 2017-216206 filed on Nov. 9, 2017, the contents of which are incorporated herein by reference.

BACKGROUND

The present invention relates to a vehicle exhaust device.

In a vehicle exhaust device, there is a device that switches a flow path of exhaust gas flowing through a muffler by opening and closing an exhaust control valve (switching valve) disposed at an upstream side of the muffler (for example, see Japanese Patent Application Publication No, H02-248609). In the exhaust device described in Patent Document 1, an internal space of the muffler is partitioned into a plurality of muffler chambers by partition plates. The partition plates are provided with baffle pipes that connect the muffler chambers with each other. Further, the muffler is provided with a main pipe constituting an exhaust passage at high speed and a sub pipe constituting an exhaust passage at low speed, and a connecting portion of the main pipe and the sub pipe is provided with a switching valve that is controlled to be open and closed in accordance with engine rotation speed. By opening and closing the switching valve, the flow path of exhaust gas can be switched at high speed and medium or low speed.

Patent Document 1: Japanese Patent Publication No. H02-248609

SUMMARY

According to an aspect of the present disclosure, there is provided a vehicle exhaust device including:

a muffler body that has an interior space divided into a plurality of expansion chambers by a partition wall; and an exhaust control valve that switches an exhaust passage in the muffler body, wherein the exhaust passage includes:

a first exhaust passage that connects an upstream end and a downstream end of the muffler body straight, and a second exhaust passage that passes through the plurality of expansion chambers via a connecting pipe that connects the plurality of expansion chambers, and a center of the first exhaust passage is located above a center of the muffler body in a vehicle upper-lower direction, and the second exhaust passage is located below the first exhaust passage.

DETAILED DESCRIPTION OF EXEMPLIFIED EMBODIMENT

In Japanese Patent Application Publication No. H02-248609, exhaust gas flowing through the main pipe passes through the plurality of muffler chambers before being discharged. Therefore, the exhaust gas expands every time when flowing into the muffling chambers. As a result, back pressure increases, and it is difficult to obtain sufficient output at high speed. Further, in Japanese Patent Application Publication No. H02-248609, the number of pipes in the muffler is large, which may cause an increase in size and weight of the muffler. Particularly, with the increase in size of the muffler, it is difficult to ensure a bank angle of the vehicle.

Aspect of non-limiting embodiments of the present disclosure relates to a vehicle exhaust device capable of improving output characteristics during high rotation of the engine and ensuring a bank angle of the vehicle.

Hereinafter, embodiments of the present invention are described in detail with reference to the accompanying drawings. Although an example is described in which the present invention is applied to motorcycle of a sport type, but the application subject is not limited thereto and modifications may be made. For example, the vehicle exhaust device according to the present invention may be applied to a motorcycle of other types, an automatic three-wheeled vehicle of a buggy type, and an automobile. In terms of direction, an arrow FR indicates a vehicle front side, the arrow RE indicates a vehicle rear side, an arrow L indicates a vehicle left side, an arrow R indicates a vehicle right side, an arrow UP indicates a vehicle upper side, and an arrow LO indicates a vehicle lower side respectively. In the following drawings, a part of components are omitted for convenience of description.

Figure 1:
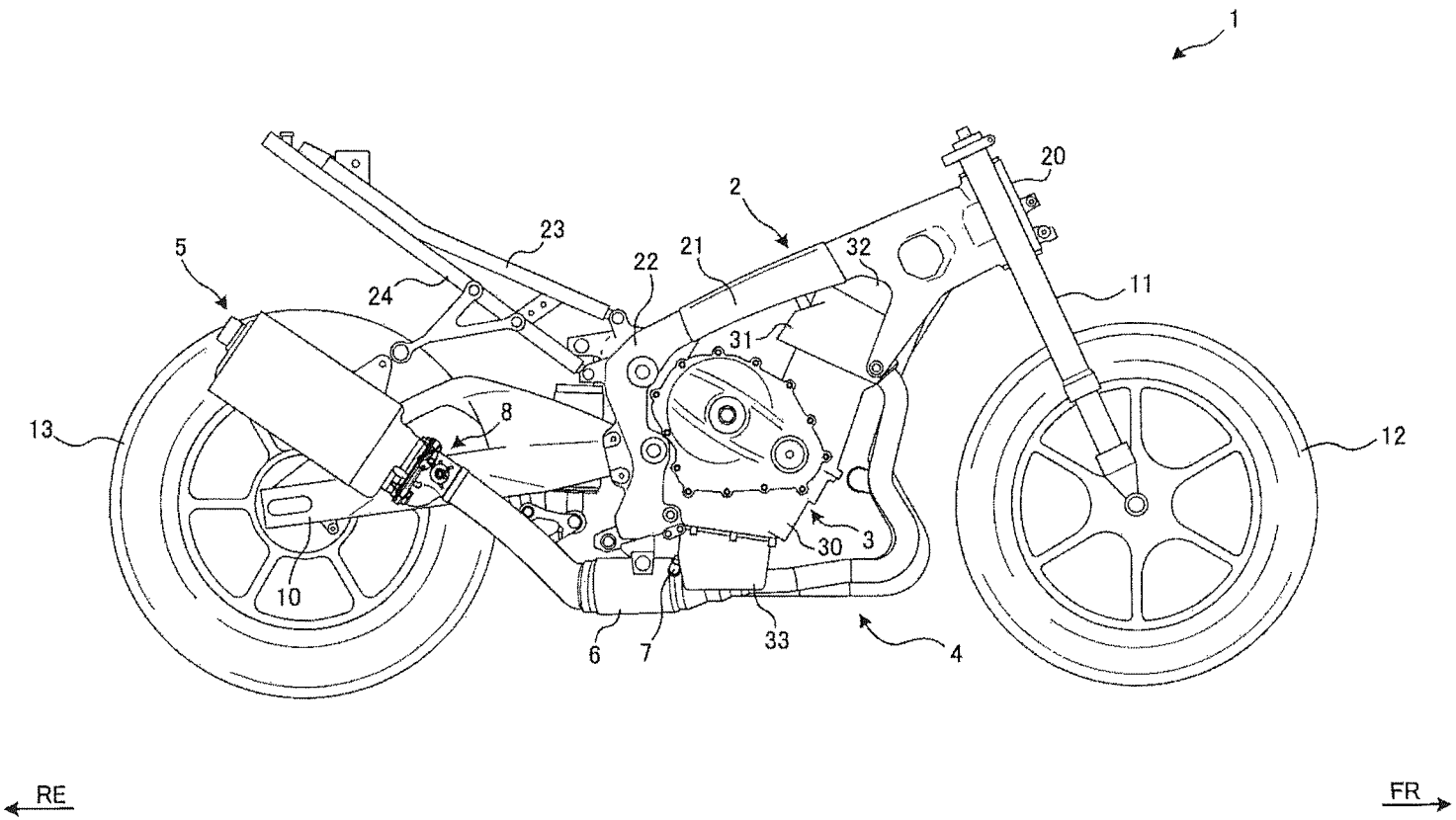
FIG. 1 is a right side view illustrating a schematic configuration of a motorcycle.

A schematic configuration of a motorcycle to which the present invention is applied is described with reference to FIG. 1. FIG. 1 is a right side view illustrating the schematic configuration of the motorcycle.

As illustrated in FIG. 1, a motorcycle 1 has a structure such that an engine 3 is suspended as a part of a power unit on a vehicle body frame 2 on which portions such as an electrical system are mounted. The engine 3 is, for example, a parallel four-cylinder engine. The engine 3 is configured such that a cylinder head 31 and a cylinder head cover 32 are attached to an upper portion of an engine case 30 in which a crankshaft (not illustrated) and the like is housed. An oil pan 33 is provided below the engine case 30.

The vehicle body frame 2 is a twin spar type frame formed by aluminum casting, and obtains rigidity as an entire vehicle body by suspending the engine 3 as described above. The entire vehicle body frame 2 has a shape that extends rearward from a front side and is curved downward at a rear end side.

Specifically, the vehicle body frame 2 includes a main frame 21 extending rearward from a head pipe 20 in a bifurcated manner and a body frame 22 extending downward from a rear end of the main frame 21. A fuel tank (not illustrated) is disposed at an upper portion of the main frame 21. A swing arm 10 is swingably supported at a substantially central part of the body frame 22 in an upper-lower direction. The swing arm 10 extends rearward.

A seat rail 23 and a back stay 24 extending rearward and upward are provided at an upper end of the body frame 22. The seat rail 23 is provided with a rider seat and a pillion seat (neither illustrated).

A pair of left and right front forks 11 is supported on the head pipe 20 via a steering shaft (not illustrated) so as to be able to be steered. A front wheel 12 is rotatably supported at a lower portion of the front fork 11, and an upper side of the front wheel 12 is covered with a front fender (not illustrated). A rear wheel 13 is rotatably supported at a rear end of the swing arm 10. An upper side of the rear wheel 13 is covered with a rear fender (not illustrated).

An exhaust pipe 4 and a muffler 5 that serve as an exhaust device are connected to exhaust ports of the cylinder head 31. A plurality of (four in the present embodiment) exhaust pipes 4 extend downward from the exhaust ports, are bundled into one pipe after being bent rearward at a lower front side of the engine 3, and extend toward the vehicle rear side.

A catalytic device 6 that purifies exhaust gas is provided in middle of the exhaust pipe 4. The catalytic device 6 includes, for example, a three-way catalyst that adsorbs pollutants (carbon monoxide, hydrocarbons, nitrogen oxide, and the like) in the exhaust gas and converts the pollutants into harmless substances (carbon dioxide, water, nitrogen, and the like). An exhaust gas sensor 7 that detects a predetermined component in exhaust gas flowing through the exhaust pipe 4 is provided at an upstream side of the catalytic device 6. The exhaust gas sensor 7 is, for example, a zirconia type oxygen sensor, and output (current value) thereof changes in accordance with oxygen concentration in the exhaust gas. The current value is output to an Electronic Control Unit (ECU) (not illustrated).

The muffler 5 is connected to a rear end of the exhaust pipe 4. The muffler 5 is disposed on a right side of the rear wheel 13. A connecting part of the exhaust pipe 4 and the muffler 5 is provided with an exhaust control valve 8 that switches an exhaust passage. The muffler 5 and the exhaust control valve 8 are described below.

Figure 2:
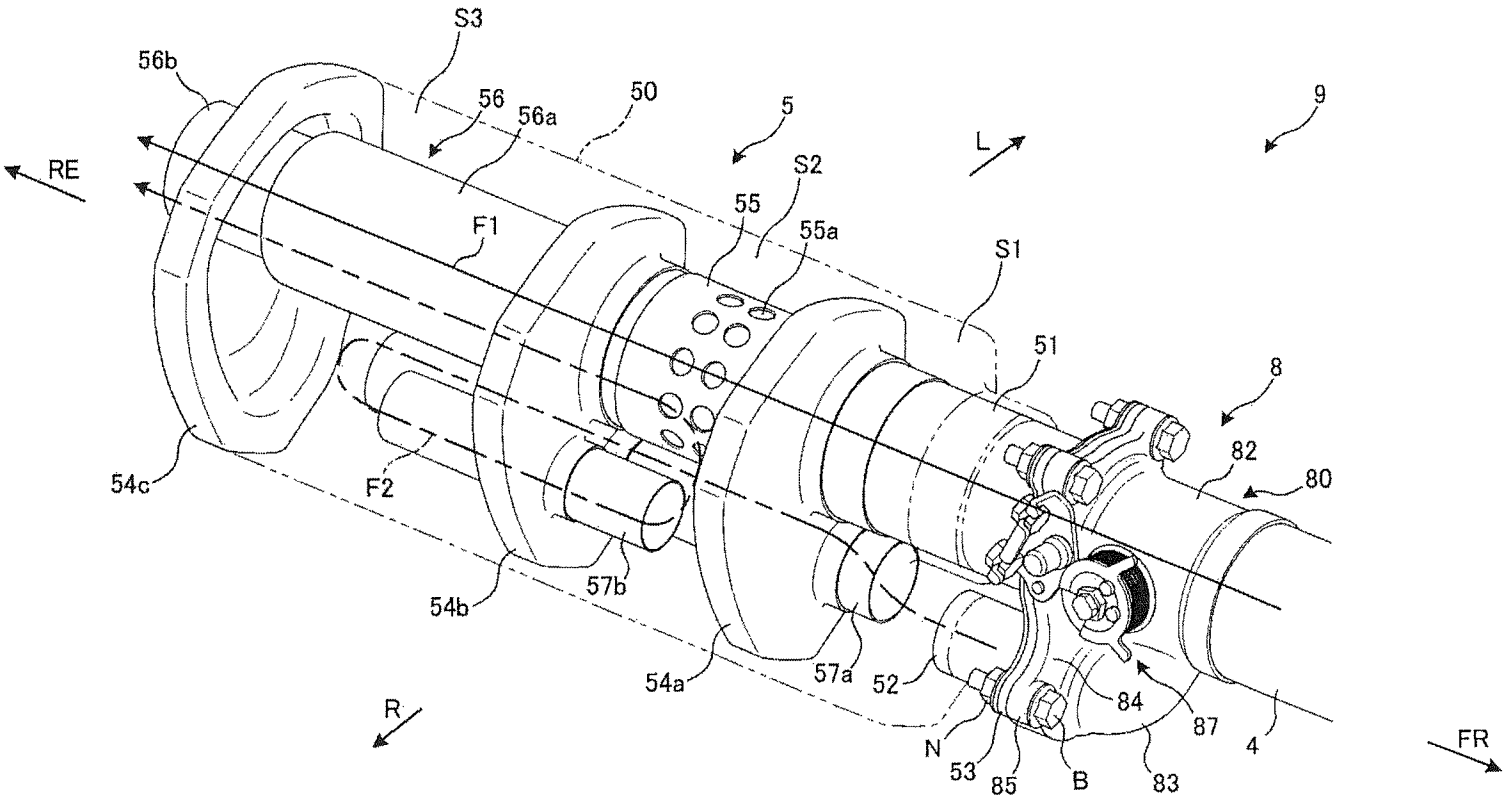
FIG. 2 is a perspective view illustrating an internal structure of an exhaust device according to an embodiment.
Figure 3:
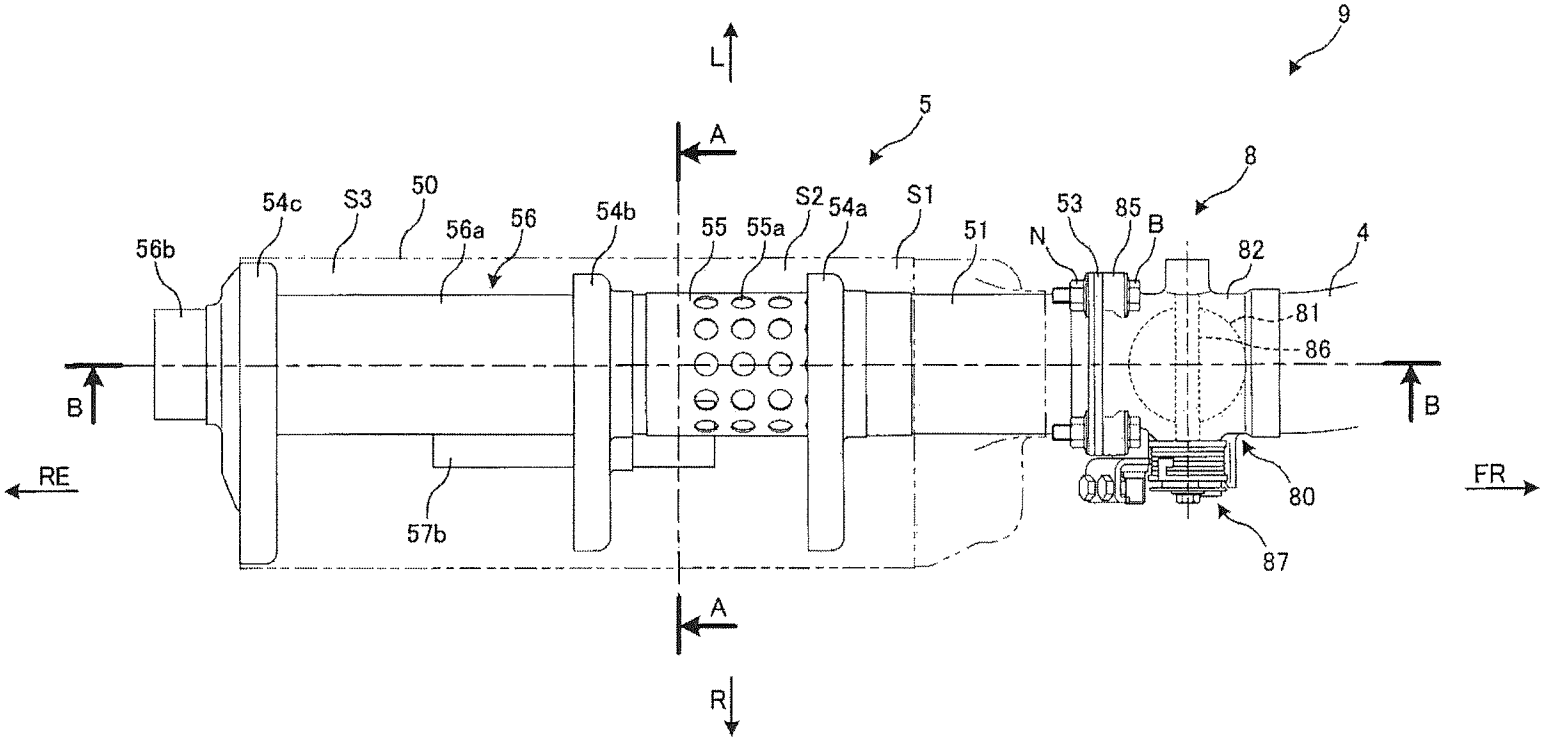
FIG. 3 is a top view illustrating the internal structure of an exhaust device according to the embodiment.
Figure 4:
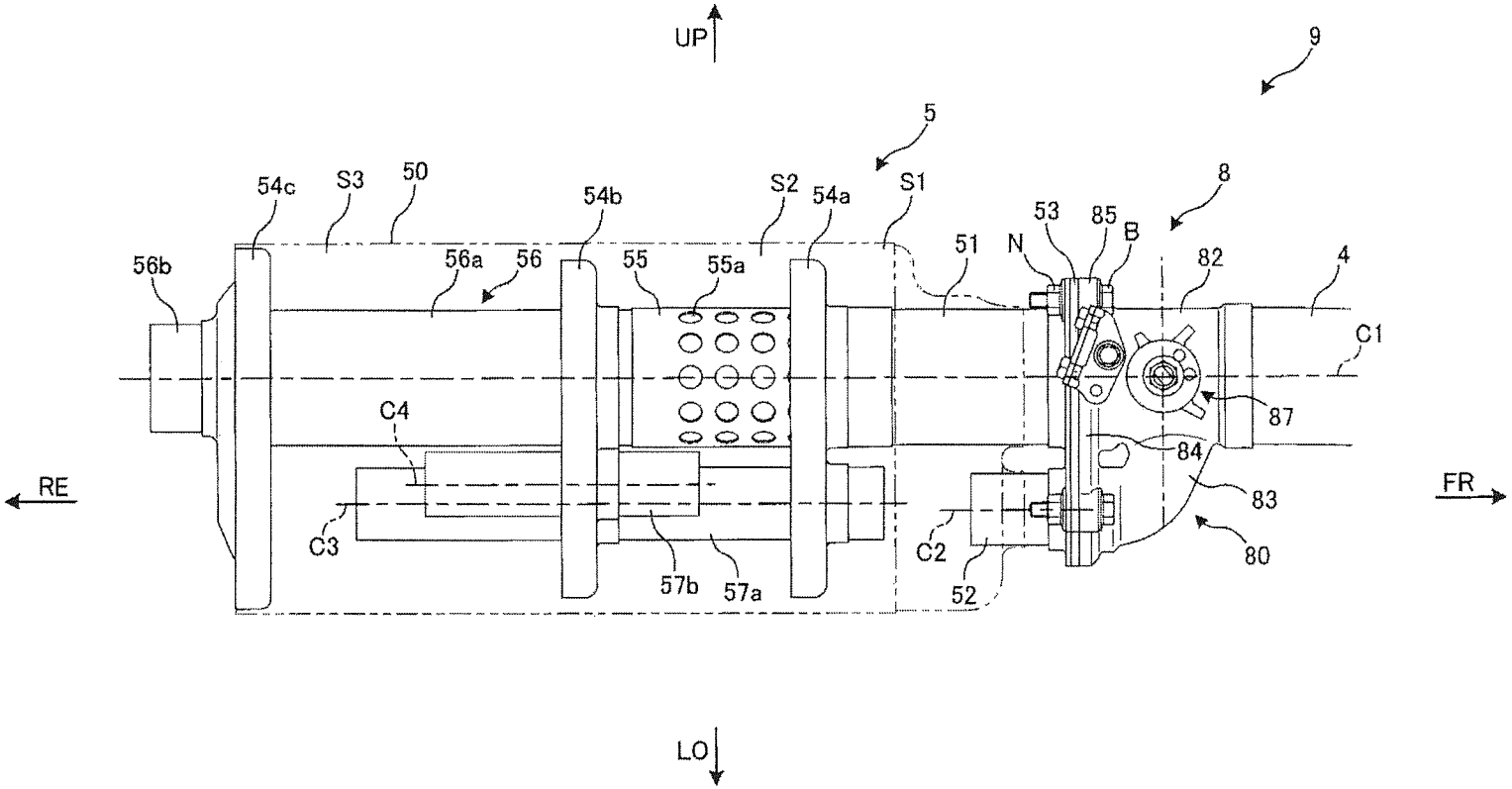
FIG. 4 is a side view illustrating the internal structure of an exhaust device according to the embodiment.
Figure 5:
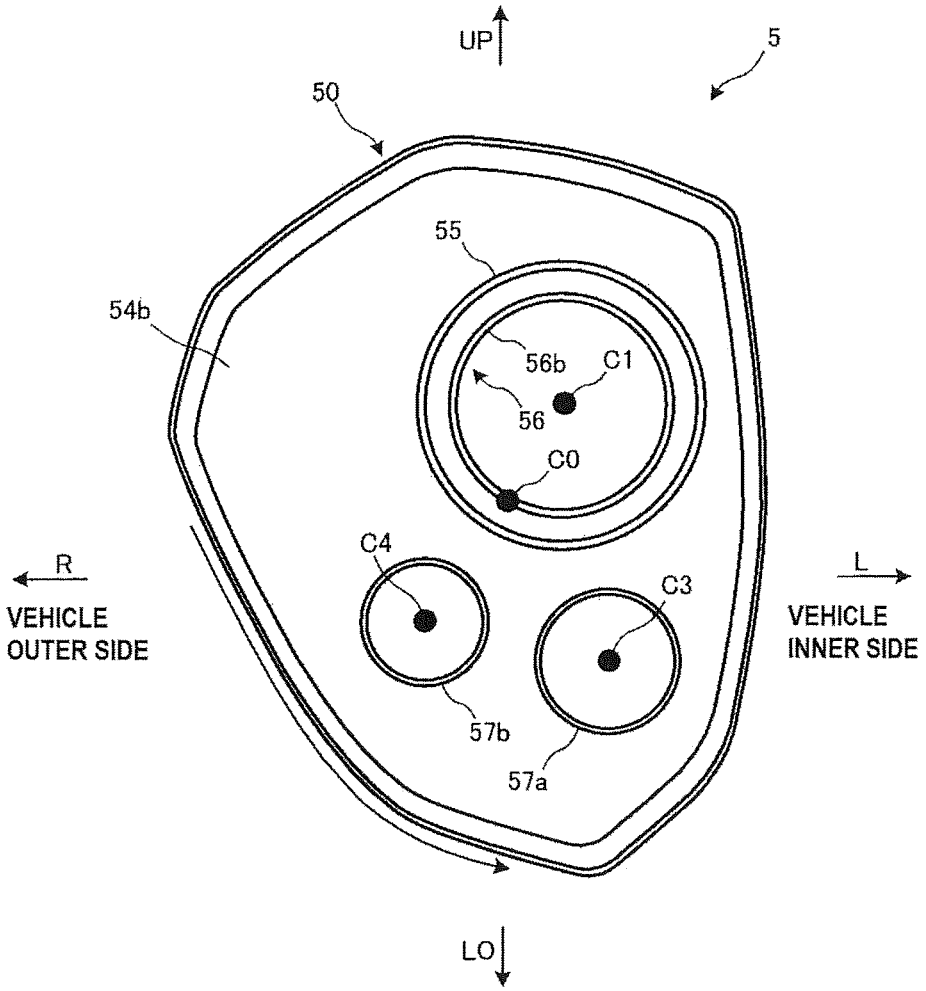
FIG. 5 is a cross sectional view taken along a line A-A in FIG. 3.
Figure 6:
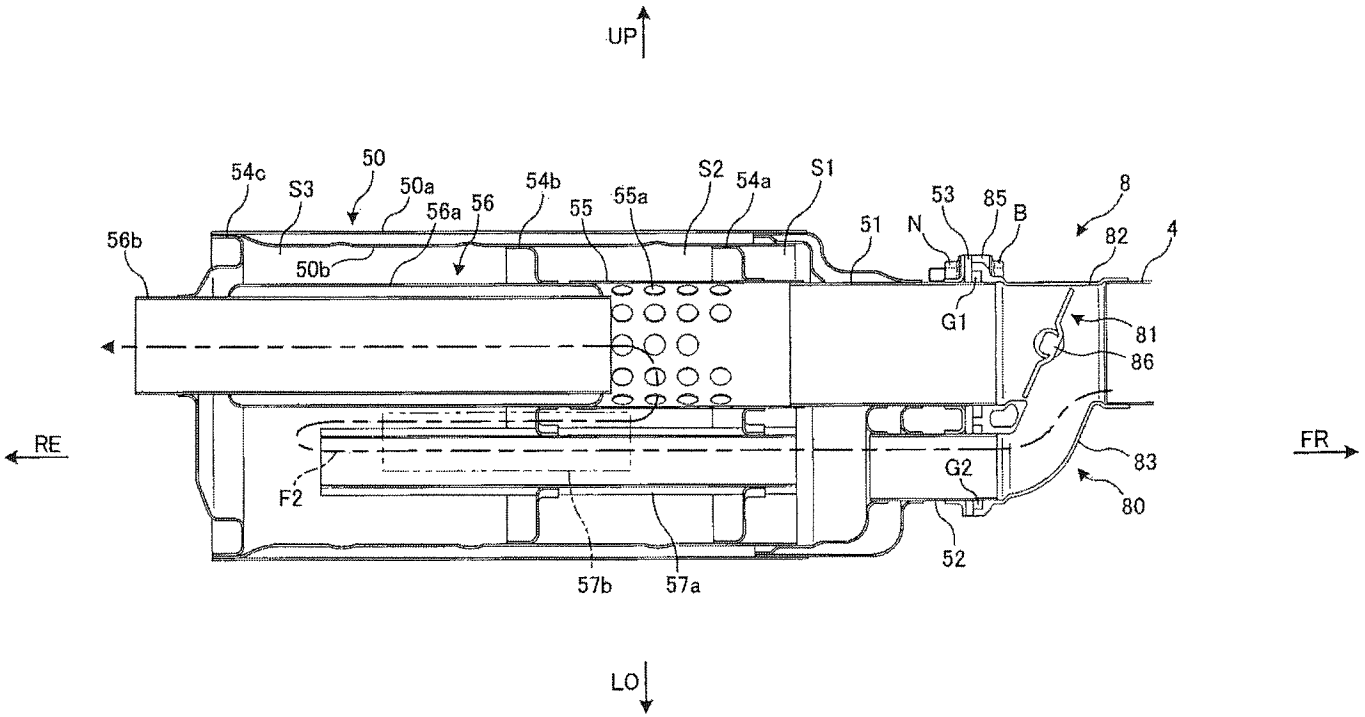
FIG. 6 is a cross sectional view taken along a line B-B in FIG. 3 and illustrating a state in which an exhaust control valve is closed.

Next, a vehicle exhaust device according to the present embodiment is described with reference to FIGS. 2 to 6. FIG. 2 is a perspective view illustrating an internal structure of the exhaust device according to the present embodiment. FIG. 3 is a top view illustrating the internal structure of the exhaust device according to the embodiment. FIG. 4 is a side view illustrating the internal structure of the exhaust device according to the embodiment. FIG. 5 is a cross sectional view taken along a line A-A in FIG. 3. FIG. 6 is a cross sectional view taken along a line B-B in FIG. 3.

As illustrated in FIGS. 2 to 6, a vehicle exhaust device 9 includes the exhaust pipe 4 extending from the engine 3 (see FIG. 1) and forming a part of an exhaust passage, the muffler 5 connected to a downstream end of the exhaust pipe 4, and the exhaust control valve 8 that switches an exhaust passage in the muffler 5. The exhaust pipe 4 and the muffler 5 are connected via the exhaust control valve 8. An exhaust passage for discharging exhaust gas from the engine is formed by the exhaust pipe 4, the exhaust control valve 8, and the muffler 5.

The exhaust control valve 8 includes a so-called butterfly valve in which a plate-shaped valve member 81 is disposed in a valve body 80. The valve body 80 connects the exhaust pipe 4 extending from the engine 3 (the cylinder head 31) and the muffler 5 (a muffler body 50 to be described below). The valve body 80 is formed of, for example, a cast. Specifically, the valve body 80 includes a main portion 82 constituting a part of a main passage (a first exhaust passage F1 to be described below) of exhaust gas and a bypass portion 83 connected to the main portion 82 and constituting a part of a bypass passage (a second exhaust passage F2 to be described below) of exhaust gas.

The main portion 82 has a cylindrical shape extending rearward from the downstream end of the exhaust pipe 4. The bypass portion 83 has a cylindrical shape bent rearward at a substantially right angle after protruding downward from a lower outer surface of the main portion 82. That is, the bypass portion 83 is located below the main portion 82. The main portion 82 has substantially the same diameter as that of the downstream end of the exhaust pipe 4, and the bypass portion 83 has a diameter smaller than that of the main portion 82.

Downstream ends of the main portion 82 and the bypass portion 83 are flush with each other, and a plate-shaped flange portion 84 expanding radially outward is formed to connect the downstream ends. The flange portion 84 includes a plurality of fastening portions 85 for bolting the muffler 5.

The valve element 81 is disposed in the main portion 82 and is formed into a circular shape complementary to the inner diameter of the main portion 82. The valve element 81 is provided with a rotation shaft 86 passing through a diameter part thereof. The rotation shaft 86 constitutes a rotation center of the valve element 81, and is disposed in a center of the valve element 81 in a plane perpendicular to a thickness direction of the valve element 81. An axial direction of the rotation shaft 86 is directed to a direction (left-right direction) perpendicular to an axial direction of an exhaust passage (extending direction of the main portion 82).

The rotation shaft 86 penetrates the main portion 82 laterally, and an end portion of the rotation shaft 86 is provided with an actuator 87 on a right side surface of the main portion 82. The actuator 87 includes, for example, a torsion spring, and the valve element 81 is always urged to be closed by urging force of the torsion spring.

As engine rotation speed and exhaust pressure increase, the valve element 81 rotates against the urging force of the torsion spring to control switching of an exhaust passage. Additionally, the valve element 81 is not limited to a case in which rotation is controlled by a mechanical configuration such as the above torsion spring, and may be electrically controlled by the ECU.

In the exhaust control valve 8 as described above, a cross-sectional area of an exhaust passage is enlarged and reduced by rotating the valve element 81 around the rotation shaft 86, such that an opening degree of the exhaust passage is adjusted. Accordingly, the exhaust passage is switched between the first exhaust passage F1 and the second exhaust passage F2 to be described below, and a flow rate and a flow velocity of exhaust gas can be adjusted. As to be described in detail below, the valve element 81 opens and closes the main part 82 in accordance with the engine rotation speed and/or the exhaust pressure, and guides exhaust gas to the bypass part 83 when the main part 82 is closed.

The muffler 5 includes a muffler body 50 that has an internal space of a predetermined shape (for example, a single cross-sectional shape in the axial direction) extending in a front-rear direction. The entire muffler body 50 has a diameter larger than that of the valve body 80, and has a double pipe structure in which an outer cylindrical portion 50*a* and an inner cylindrical portion 50*b* are overlapped. A tip end part of the muffler body 50 is reduced in diameter, and has an outer diameter corresponding to that of the valve body 80.

The tip end of the muffler body 50 is provided (welded) with a main pipe 51 and a sub pipe 52 corresponding to the main portion 82 and the bypass portion 83 of the valve body 80. That is, the main pipe 51 is located at an upper half portion of the muffler body 50, and the sub pipe 52 is located at a lower half portion of the muffler body 50. The main pipe 51 has substantially the same diameter as that of the main portion 82, and the sub pipe 52 has substantially the same diameter as that of the bypass portion 83. The main pipe 51 and the sub pipe 52 extend rearward linearly.

Further, a plate-shaped flange portion 53 corresponding to (opposing) the flange portion 84 of the valve body 80 is welded at tip end sides of the main pipe 51 and the sub pipe 52. The flange portion 53 includes a plurality of bolt insertion holes (not illustrated) corresponding to the fastening portions 85 of the flange portion 84. Gaskets G1 and G2 (see FIG. 6) are inserted respectively into the main pipe 51 and the sub pipe 52, and the tip ends of the pipes are inserted respectively into the main portion 82 and the bypass portion 83. The flange portion 84 and the flange portion 53 are fastened by a bolt B and a nut N, such that the valve body 80 and the muffler body 50 are integrated.

The inner space of the muffler body 50 is divided into a plurality of expansion chambers by a partition wall. In the embodiment, the inner space of the muffler body 50 is divided into three expansion chambers S1 to S3 in the front-rear direction by three partition walls (baffle plates 54*a* to 54*c*). The three partition walls are disposed in an order of the baffle plate 54*a*, the baffle plate 54*b*, and the baffle plate 54*c* from a front side of the muffler 5. A space in front of the baffle plate 54*a* is the expansion chamber S1, a space between the baffle plates 54*a* and 54*b* is the expansion chamber S2, and a space between the baffle plates 54*b* and 54*c* is the expansion chamber S3.

The main pipe 51 extends to the baffle plate 54*a* in the expansion chamber S1. A punching pipe 55 having the same diameter is welded at a rear end of the main pipe 51. The punching pipe 55 extends rearward linearly. Specifically, the punching pipe 55 penetrates the baffle plate 54*a* and extends to the baffle plate 54*b* in the expansion chamber S2. The punching pipe 55 includes a plurality of through holes 55*a* in an outer surface thereof in the expansion chamber S2.

A tail pipe 56 is connected to a rear end of the punching pipe 55. In the embodiment, the tail pipe 56 is welded at the rear end of the punching pipe 55. The tail pipe 56 constitutes a downstream end portion of the first exhaust passage F1 to be described below. The tail pipe 56 extends rearward linearly and has a double pipe structure in which an outer cylindrical portion 56*a* and an inner cylindrical portion 56*b* are overlapped. The outer cylindrical portion 56*a* has the same diameter as that of the punching pipe 55, and the inner cylindrical portion 56*b* has a diameter smaller than that of the punching pipe 55.

The outer cylindrical portion 56*a* penetrates the baffle plate 54*b* and extends to the baffle plate 54*c* in the expansion chamber S3. The inner cylindrical portion 56*b* extends further rearward than the outer cylindrical portion 56*a*, and passes through the baffle plate 54*c* such that a rear end thereof is exposed. That is, the entire tail pipe 56 is not a double pipe structure, and a part of the tail pipe 56 excluding the rear end part (a part corresponding to the expansion chamber S3 and a part of the expansion chamber S2) has the double pipe structure.

In this way, the main pipe 51, the punching pipe 55, and the tail pipe 56 form an exhaust passage that connects an upstream end and a downstream end of the muffler body 50 straight. This exhaust passage is referred to as the first exhaust passage F1 (see FIG. 6). That is, the main portion 82 is connected to the first exhaust passage F1. As to be described in detail below, a center C1 of the first exhaust passage F1 is located above a center C0 of the muffler body 50.

Two baffle pipes 57*a* and 57*b* having different diameters are disposed below the first exhaust passage F1. The baffle pipe 57*a* (a first pipe) extends rearward in parallel to the first exhaust passage F1 straight below the first exhaust passage F1 and behind the sub pipe 52. The baffle pipe 57*a* has substantially the same diameter as that of the sub pipe 52, and a center C3 thereof is slightly above a center C2 of the sub pipe 52 and closer to a vehicle inner side than C2. A tip end of the baffle pipe 57*a* is located in the expansion chamber S1, and a rear end of the baffle pipe 57*a* is located in the expansion chamber S3. That is, the baffle pipe 57*a* penetrates the baffle plates 54*a* and 54*b*. The expansion chamber S1 and the expansion chamber S3 are connected with each other via the baffle pipe 57*a*.

The baffle pipe 57*b* (a second pipe) extends rearward in parallel to the first exhaust passage F1 on a lower right side thereof. The baffle pipe 57*a* has a diameter larger than a diameter of the baffle pipe 57*b*. In the embodiment, the baffle pipe 57*b* has a diameter slightly smaller than that of the baffle pipe 57*a*, and a center C4 thereof is located above the center C3 of the baffle pipe 57*a* and closer to a vehicle outer side than C3. A tip end of the baffle pipe 57*b* is located in the expansion chamber S2, and a rear end of the baffle pipe 57*b* is located in the expansion chamber S3. That is, the baffle pipe 57*b* penetrates the baffle plate 54*b*. The expansion chamber S2 and the expansion chamber S3 are connected via the baffle pipe 57*b*.

In this way, the sub pipe 52 and the baffle pipes 57*a* and 57*b* form a new exhaust passage passing through the expansion chambers S1 to S3. This exhaust passage is referred to as the second exhaust passage. That is, the bypass portion 83 is connected to the second exhaust passage F2. The second exhaust passage F2 is located below the first exhaust passage F1.

In the exhaust device 9 configured as described above, exhaust gas generated by combustion of the engine 3 is introduced from the exhaust ports into the muffler 5 through the exhaust pipe 4 and the exhaust control valve 8. When exhaust pressure of the exhaust gas is less than predetermined pressure, the exhaust control valve 8 is closed, and the exhaust gas is discharged outside through the second exhaust passage F2 from the bypass portion 83. Meanwhile, when the exhaust pressure of the exhaust gas increases as engine rotation speed increases and exceeds the predetermined pressure, the exhaust control valve 8 (main portion 82) is open. As a result, the exhaust gas is discharged through the first exhaust passage F1 from the main portion 82. In this way, the exhaust passage can be switched in accordance with the engine rotation speed and the exhaust pressure.

As described above, there is a device in a vehicle exhaust device that switches the exhaust passage between high speed and medium or low speed. For example, the exhaust passage is switched to a relatively short exhaust passage at high speed, and is switched to a relatively long exhaust passage at medium or low speed. However, even when a relatively short exhaust passage is selected at high speed, the exhaust pressure is increased by repeating expansion in the exhaust passage, and sufficiently high output is difficult to be obtained. Further, an increase in size and weight of the muffler is a problem due to the number of pipes disposed in the muffler. Particularly, with the increase in size of the muffler, it is difficult to ensure a bank angle of the vehicle.

Therefore, the inventor of the present invention has made the present invention by focusing on length of two exhaust passages at high speed and a positional relationship between the two exhaust passages in the exhaust device that switches the two exhaust passages at high speed and medium or low speed. Specifically, according to the present embodiment, the first exhaust passage F1 selected at high speed is formed at a shortest distance by connecting the upstream end and the downstream end of the muffler body 50 straight. Meanwhile, the second exhaust passage F2 selected at medium or low speed is formed to detour through the plurality of expansion chambers S1 to S3 in the muffler 5. The second exhaust passage F2 is disposed below the first exhaust passage F1.

According to this configuration, the first exhaust passage F1 is formed linearly, such that the exhaust pressure in a high rotation range can be reduced, and output can be improved. Since the first exhaust passage F1 is formed straight, the number of pipes in the muffler 5 can be reduced, and a degree of freedom of a shape of the muffler is improved. Further, since the first exhaust passage F1 and the second exhaust passage F2 are disposed vertically, a width size of the muffler 5 can be reduced. In this way, the bank angle is easily ensured, and an appearance can be improved.

Particularly, a diameter of the first exhaust passage F1 (the main pipe 51, the punching pipe 55, and the tail pipe 56) is larger than that of the second exhaust passage F2 (the sub pipe 52 and the baffle pipes 57*a* and 57*b*). The baffle pipe 57*a* having a diameter larger than that of the baffle pipe 57*b* is disposed closer to the vehicle inner side than the baffle pipe 57*b*. By disposing the second exhaust passage F2 below the first exhaust passage F1 in this way, a cross section of the muffler 5 can be made narrower as approaching a lower side thereof (see FIG. 5). More specifically, an outer surface of a lower half portion of the muffler 5 that is closer to the vehicle outer side is inclined toward the vehicle inner side as approaching the lower side. As a result, the bank angle can be more easily ensured.

As shown in FIG. 5, a center of the first exhaust passage is located above a center of the muffler body in a vehicle upper-lower direction and is located closer to a vehicle inner side than the center of the muffler body, and the second exhaust passage is located below the first exhaust passage. Further, a center of the first pipe and a center of the second pipe are disposed closer to a vehicle lower side than the center of the muffler body, and the first pipe is disposed closer to the vehicle lower side than the second pipe (See FIG. 5). Additionally, as shown in FIG. 5, a center of the first pipe is located closer to the vehicle inner side than the center of the first exhaust passage.

Figure 7:
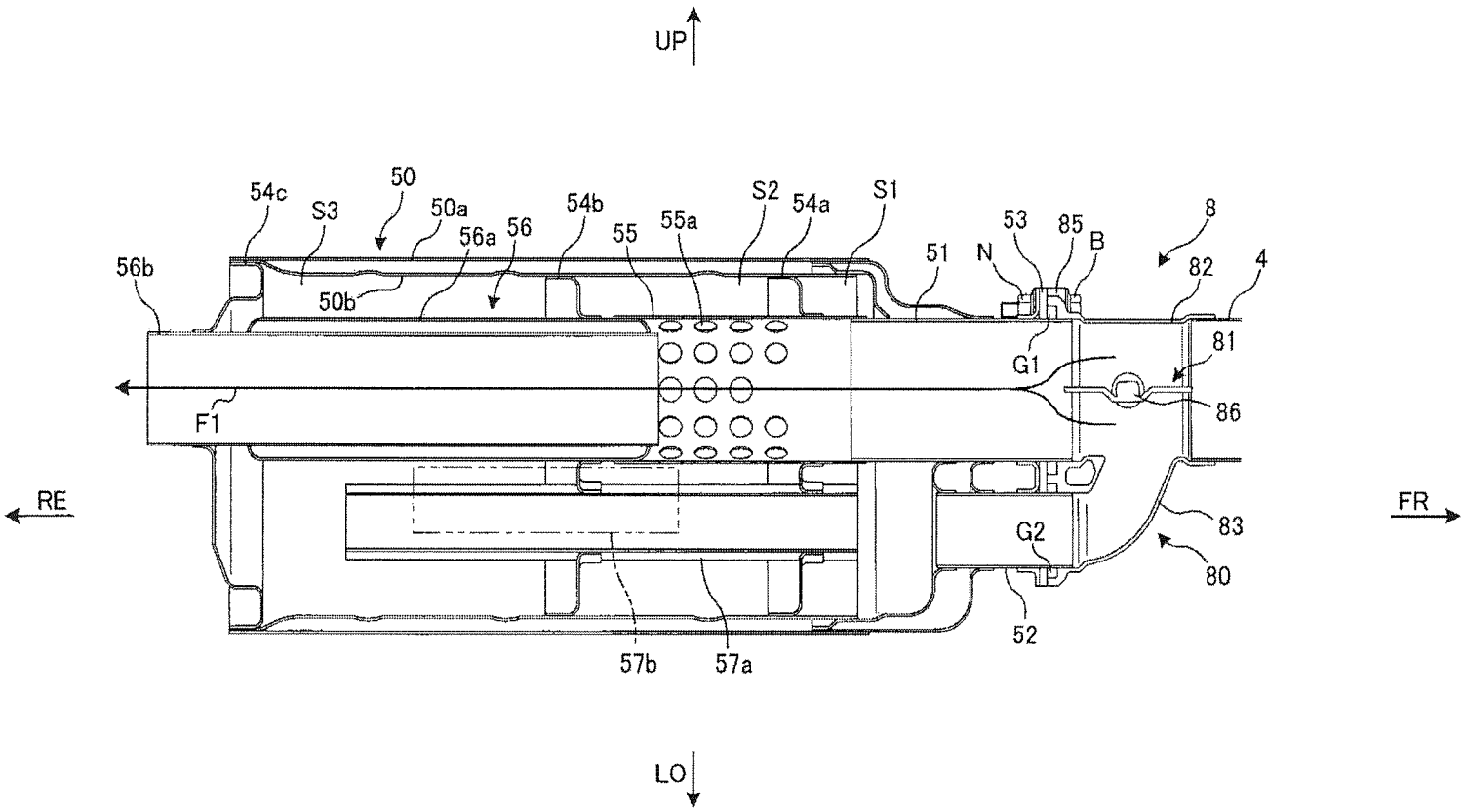
FIG. 7 is a cross sectional view taken along the line B-B in FIG. 3 and illustrating a state in which the exhaust control valve is open.

Next, an exhaust flow in the muffler is described with reference to FIGS. 6 and 7. FIGS. 6 and 7 are cross sectional views taken along a line B-B in FIG. 3. Specifically, FIG. 6 illustrates a state in which the exhaust control valve is closed, and FIG. 7 illustrates a state in which the exhaust control valve is open.

As illustrated in FIG. 6, when the exhaust control valve 8 is closed, an upstream end portion of the valve element 81 approaches an upper inner surface of the main portion 82 by the urging force of the spring, while a downstream end portion of the valve element 81 approaches a lower inner surface of the main portion 82. In this case, exhaust gas flowing through the exhaust pipe 4 is guided to the bypass portion 83 with the valve element 81 serving as a guide wall and the flow path bent downward.

Thereafter, the exhaust gas flows into the expansion chamber S1 through the sub pipe 52 and expands. Then, the exhaust gas flows into the expansion chamber S3 from the expansion chamber S1 through the baffle pipe 57*a* and expands again. Next, the exhaust gas flows into the expansion chamber S2 from the expansion chamber S3 through the baffle pipe 57*b* and expands again. Further, the exhaust gas flows into the punching pipe 55 (first exhaust passage F1) through the plurality of through holes 55*a* and is discharged outside through the tail pipe 56.

In this way, the relatively long second exhaust passage F2 is selected when the exhaust control valve 8 is closed, that is, in a medium or low rotation range of the engine 3. Therefore, exhaust gas flowing through the second exhaust passage can increase the exhaust pressure by repeating expansion in the passage, and stronger torque characteristics can be obtained in the medium or low rotation range.

Particularly, the exhaust control valve 8 is disposed at an upstream side (front side) of the muffler body 50, and the exhaust passage branches into two of the first exhaust passage F1 and the second exhaust passage F2 at the upstream side of the muffler body 50. Accordingly, the passage to the expansion chamber S1 in the second exhaust passage F2 can be made long, and the torque characteristics at low rotation can be improved. Further, length of the second exhaust passage F2 can be ensured without sacrificing the space in the muffler 5, and downsizing of the muffler 5 can also be realized.

Further, since exhaust gas in the expansion chamber S2 flows into the first exhaust passage F1 through the plurality of through holes 55*a*, a part of the first exhaust passage F1 can be utilized as the second exhaust passage F2. That is, by sharing the first exhaust passage F1 and the second exhaust passage F2, the number of pipes in the muffler 5 can be reduced, and the degree of freedom of pipe layout in the muffler 5 is improved. Further, by employing the through holes 55*a*, exhaust gas from the first exhaust passage F1 hardly leaks from the punching pipe 55, such that the exhaust gas in the second exhaust passage can be sufficiently expanded in the expansion chamber S2. As a result, noise performance can also be satisfied.

Further, at least a part of the baffle pipes 57*a* and 57*b* overlaps the plurality of through holes 55*a* in the vehicle front-rear direction. Accordingly, space in the expansion chamber S2 can be effectively utilized, and the exhaust gas can be sufficiently expanded.

Meanwhile, when the exhaust pressure of the exhaust gas increases as engine rotation speed increases and exceeds the predetermined pressure, the exhaust control valve 8 (main portion 82) is open. Specifically, in the high rotation range of the engine 3, the valve element 81 rotates around the rotation shaft 86 against the urging force of the spring. At this time, the upstream end portion of the valve element 81 is separated from the upper inner surface of the main portion 82, and the downstream end portion of the valve element 81 is also separated from the lower inner surface of the main portion 82. Accordingly, as illustrated in FIG. 7, a surface direction of the valve element 81 is parallel to the first exhaust passage F1. In this way, the first exhaust passage F1 and the second exhaust passage F2 can be appropriately switched by opening and closing the main portion 82 in accordance with the engine rotation speed and the exhaust pressure.

When the exhaust control valve 8 is open, exhaust gas flowing through the exhaust pipe 4 flows directly into the first exhaust passage F1 through the main portion 82. That is, the exhaust gas is discharged outside through the main pipe 51, the punching pipe 55, and the tail pipe 56. In this way, in the rear rotation range of the engine 3, since the exhaust gas is directly discharged outside without passing through the expansion chambers S1 to S3 in the muffler 5, high output can be ensured without increasing the exhaust pressure.

Particularly, in the downstream side of the first exhaust passage F1, the diameter of the tail pipe 56 (the inner cylinder portion 56*b*) is smaller than that of the punching pipe 55. That is, by narrowing the diameter of the first exhaust passage F1 as approaching the downstream side, an exhaust sound quality can be adjusted, and the exhaust gas from the second exhaust passage F2 can be easily guided outside.

As described above, in the present embodiment, the linear first exhaust passage F1 and the second exhaust passage F2 that has a relatively long distance that detours through the muffler 5 are switched in accordance with the engine rotation speed, and these two exhaust passages are disposed vertically. According to such a configuration, both high output over a wide range of the engine rotation speed and the bank angle of the vehicle can be ensured.

Additionally, although the above embodiment has been described taking the parallel four-cylinder engine 3 as an example, the present invention is not limited thereto. For example, the engine 3 may be an engine of a single cylinder or three or more cylinders, and arrangement of the cylinders is not limited to be parallel and may be changed as appropriate.

Further, in the above embodiment, the vehicle body frame 2 is a twin spar type frame, but the present invention is not limited thereto. The vehicle body frame 2 may be, for example, a frame of a diamond type or other types.

In the above embodiment, the rotation shaft 86 of the valve element 81 passes through the center of the valve element 81, but the present invention is not limited thereto. For example, the rotation shaft 86 may be biased to one end side of the valve element 81.

Although the present embodiment and the modification have been described, the present embodiment and the modification may be combined in whole or in part as another embodiment of the present invention.

Further, embodiments of the present invention are not limited to the above embodiment, and changes, substitutions and alterations may be made without departing from the spirit of the technical concept of the present invention. Further, if the technical concept of the present invention can be implemented in another manner by advance of technology or another derivative technology, the present invention may be implemented using the manner. Therefore, the scope of the claims covers all embodiments that may fall within the scope of the technical concept.

According to the present invention, the output characteristics during high rotation of the engine can be improved, and the bank angle of the vehicle can be ensured.

As described above, the present invention has an effect that the output characteristics during high rotation of the engine can be improved and the bank angle of the motorcycle can be ensured, and is particularly useful for the vehicle exhaust device.

What is claimed is:

1. A vehicle exhaust device comprising:

a muffler body that has an interior space divided into a plurality of expansion chambers by a partition wall; and an exhaust control valve that switches an exhaust passage in the muffler body, wherein the exhaust passage includes:

a first exhaust passage that extends inside the muffler body and connects an upstream end and a downstream end of the muffler body straight, and a second exhaust passage that passes through the plurality of expansion chambers via a connecting pipe connecting the plurality of expansion chambers and that has a diameter smaller than a diameter of the first exhaust passage, and a center of the first exhaust passage is located above a center of the muffler body in a vehicle upper-lower direction and is located closer to a vehicle inner side than the center of the muffler body, and the second exhaust passage is located below the first exhaust passage.

2. The vehicle exhaust device according to claim 1 further comprises:

a punching pipe that constitutes a part of the first exhaust passage and includes a plurality of through holes in an outer surface thereof, wherein exhaust gas flowing through the second exhaust passage flows into the first exhaust passage from the plurality of through holes and is discharged outside the muffler body through the first exhaust passage.

3. The vehicle exhaust device according to claim 2 further comprises:

a tail pipe that is connected to the punching pipe and constitutes a downstream end portion of the first exhaust passage, wherein a diameter of the tail pipe is smaller than a diameter of the punching pipe.

4. The vehicle exhaust device according to claim 2, wherein at least a part of the connecting pipe overlaps the plurality of through holes in a vehicle front-rear direction.

5. The vehicle exhaust device according to claim 1, wherein the exhaust control valve is disposed at an upstream side of the muffler body.

6. The vehicle exhaust device according to claim 1, wherein the exhaust passage is branched into two of the first exhaust passage and the second exhaust passage at the upstream side of the muffler body.

7. The vehicle exhaust device according to claim 1, wherein the connecting pipe includes a first pipe and a second pipe which are disposed below the first exhaust passage, the first pipe has a diameter larger than a diameter of the second pipe, and the first pipe is disposed closer to a vehicle inner side than the second pipe.

8. The vehicle exhaust device according to claim 7, wherein a center of the first pipe and a center of the second pipe are disposed closer to a vehicle lower side than the center of the muffler body, and the first pipe is disposed closer to the vehicle lower side than the second pipe.

9. The vehicle exhaust device according to claim 1, wherein the exhaust control valve includes:

a valve body that connects an exhaust pipe extending from the engine and the muffler body, and a valve element that is disposed in the valve body, the valve body includes:

a main portion that is connected to the first exhaust passage, and a bypass portion that is connected to the second exhaust passage, and the valve element guides exhaust gas to the bypass portion when the main portion is closed.

10. The vehicle exhaust device according to claim 7, wherein a center of the first pipe is located closer to the vehicle inner side than the center of the first exhaust passage.

* * * * *